US009661732B2

(12) United States Patent
Imai

(10) Patent No.: US 9,661,732 B2
(45) Date of Patent: May 23, 2017

(54) PLASMA GENERATION APPARATUS

(71) Applicant: Panasonic Intellectual Property Management Co., Ltd., Osaka (JP)

(72) Inventor: Shin-Ichi Imai, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 14/883,386

(22) Filed: Oct. 14, 2015

(65) Prior Publication Data

US 2016/0120013 A1 Apr. 28, 2016

(30) Foreign Application Priority Data

Oct. 24, 2014 (JP) ..... 2014-216953

(51) Int. Cl.
*H01J 7/24* (2006.01)
*H05H 1/48* (2006.01)

(52) U.S. Cl.
CPC ..... *H05H 1/48* (2013.01); *H05H 2245/121* (2013.01)

(58) Field of Classification Search
CPC ..... H05H 1/48; H05H 2245/121; A61L 2/14
See application file for complete search history.

(56) References Cited

U.S. PATENT DOCUMENTS

| | | | | |
|---|---|---|---|---|
| 2007/0240975 | A1 | 10/2007 | Foret | |
| 2009/0277776 | A1 | 11/2009 | Kono et al. | |
| 2010/0126940 | A1* | 5/2010 | Ryu | C02F 1/4608 210/744 |
| 2015/0114913 | A1* | 4/2015 | Imai | C02F 1/4608 210/748.17 |

FOREIGN PATENT DOCUMENTS

| | | | |
|---|---|---|---|
| CN | 101460405 | A | 6/2009 |
| CN | 101702901 | A | 5/2010 |
| JP | 2007-080588 | | 3/2007 |
| JP | 2007-209953 | | 8/2007 |
| JP | 2009-255027 | | 11/2009 |
| JP | 2010-523326 | | 7/2010 |
| JP | 2013-123656 | | 6/2013 |
| JP | 2014-079743 | | 5/2014 |
| JP | 2014-168760 | | 9/2014 |

OTHER PUBLICATIONS

English Translation of Chinese Search Report dated Jan. 16, 2017 for the related Chinese Patent Application No. 201510569969.5.

* cited by examiner

*Primary Examiner* — Kevin Joyner
(74) *Attorney, Agent, or Firm* — McDermott Will & Emery LLP

(57) ABSTRACT

A plasma generation apparatus includes a flow path tube through which a liquid flows and which includes a concave portion and/or a convex portion on an internal wall surface thereof, a liquid feed device, a first electrode, a second electrode, a power source, and a control circuit which controls the liquid feed device and the power source. The concave portion and/or the convex portion causes, when the liquid flows therethrough, a pressure difference to be generated between at least part of the inside of the flow path tube and the external space, allowing a gas to be introduced into the liquid from the external space through a gas introduction path. The power source applies a predetermined voltage between the first electrode and the second electrode in a state in which a bubble containing the gas is generated in the liquid.

9 Claims, 8 Drawing Sheets

PLASMA GENERATION APPARATUS

BACKGROUND

1. Technical Field

The present disclosure relates to a plasma generation apparatus and a plasma generation method.

2. Description of the Related Art

Conventionally, a technique of utilizing plasma for purification or sterilization of a liquid or a gas has been studied. For example, a sterilizer which generates active species such as OH radicals by plasma so as to kill microorganisms and bacteria by the generated active species is disclosed in the specification of Japanese Unexamined Patent Application Publication No. 2009-255027.

The sterilizer disclosed in Japanese Unexamined Patent Application Publication No. 2009-255027 includes a pair of electrodes, to which a negative high-voltage pulse is applied so as to discharge. In this case, a voltage of the negative high-voltage pulse is 2 kV/cm to 50 kV/cm and a frequency thereof is 100 Hz to 20 kHz. The discharge causes vaporization of water with shock waves so as to generate bubbles made of water vapor, and then generates plasma in the bubbles.

SUMMARY

One non-limiting and exemplary embodiment provides a plasma generation apparatus and a plasma generation method which enables efficient generation of plasma.

In one general aspect, the techniques disclosed here feature a plasma generation apparatus, which includes a flow path tube through which a liquid flows, the flow path tube including at least one of a concave portion and a convex portion which is located on an internal wall surface of the flow path tube, an inside of the flow path tube communicating with an external space of the flow path tube through a gas introduction path, a liquid feed device which flows the liquid into the flow path tube, a first electrode at least part of which is located in the inside of the flow path tube; a second electrode at least part of which is located in the inside of the flow path tube, a power source which applies a predetermined voltage between the first electrode and the second electrode, and a control circuit which makes the liquid feed device flow the liquid into the flow path tube, and makes the power source apply a predetermined voltage between the first electrode and the second electrode, wherein the at least one of the concave portion and the convex portion causes, when the liquid flows therethrough, a pressure difference to be generated between at least part of the inside of the flow path tube and the external space of the flow path tube, allowing a gas to be introduced into the liquid from the external space through the gas introduction path, and wherein the power source applies the predetermined voltage between the first electrode and the second electrode in a state in which a bubble containing the gas is generated in the liquid.

It should be noted that comprehensive or specific embodiments may be implemented as a system, a method, an integrated circuit, a computer program, a storage medium, or any selective combination thereof.

Additional benefits and advantages of the disclosed embodiments will become apparent from the specification and drawings. The benefits and/or advantages may be individually obtained by the various embodiments and features of the specification and drawings, which need not all be provided in order to obtain one or more of such benefits and/or advantages.

DETAILED DESCRIPTION

Overview of Embodiments

Figure 1:
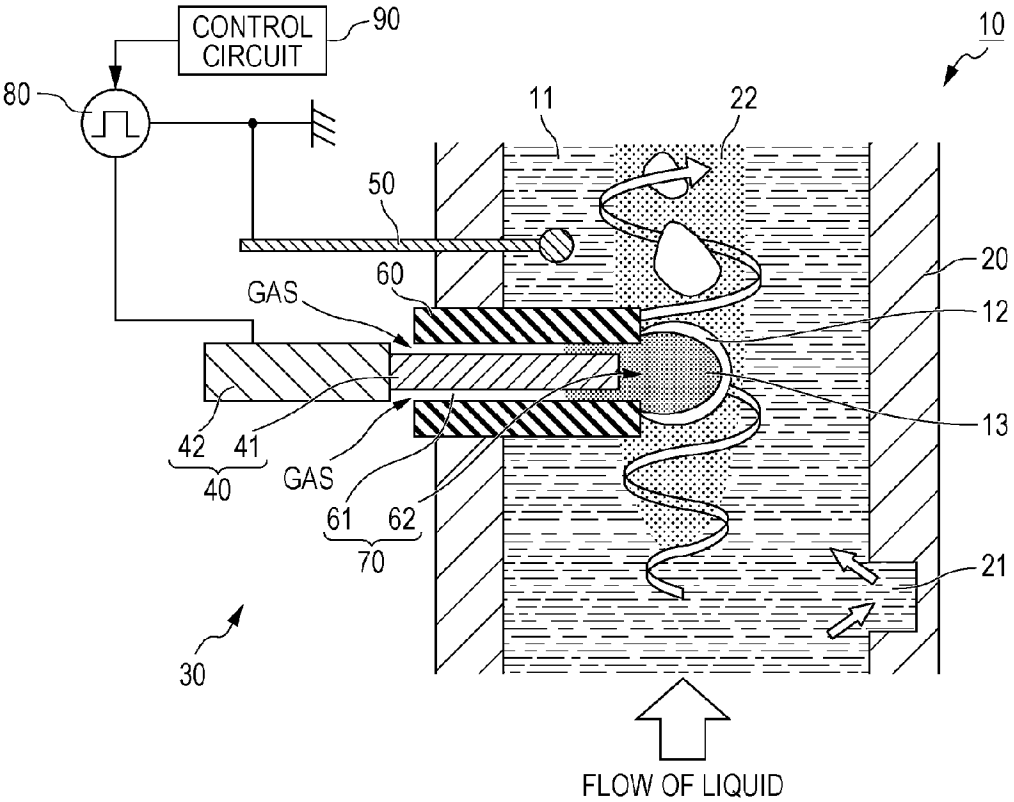
FIG. 1 illustrates the configuration of a plasma generation apparatus according to a first embodiment.

A plasma generation apparatus according to a first aspect of the present disclosure includes a flow path tube through which a liquid flows, the flow path tube including at least one of a concave portion or a convex portion which is located on an internal wall surface of the flow path tube, an inside of the flow path tube communicating with an external space of the flow path tube through a gas introduction path, a liquid feed device which flows the liquid into the flow path tube, a first electrode at least part of which is located in the inside of the flow path tube, and a second electrode at least part of which is located in the inside of the flow path tube, a power source which applies a predetermined voltage between the first electrode and the second electrode, and a control circuit which makes the liquid feed device flow the liquid into the flow path tube, and makes the power source apply a predetermined voltage between the first electrode and the second electrode, wherein the at least one of the concave portion and the convex portion causes, when the liquid flows therethrough, a pressure difference to be generated between at least part of the inside of the flow path tube and the external space of the flow path tube, allowing a gas to be introduced into the liquid from the external space through the gas introduction path, and the power source applies the predetermined voltage between the first electrode and the second electrode in a state in which a bubble containing the gas is generated in the liquid.

With this configuration, the gas can be drawn from the external space into the inside of the flow path tube by utilizing the pressure difference between at least part of the inside of the flow path tube and the external space without using a gas feed device such as a pump. Thus, plasma can be efficiently generated in the gas which is supplied to the inside of the flow path.

In addition, the liquid which flows through the flow path tube can be swirled by the concave portion and/or the convex portion without complex configuration such as a fan for swirling the liquid. Consequently, power saving and/or downsizing can be realized.

Further, for example, the concave portion may be recessed more than a peripheral portion on the internal wall surface of the flow path tube both in a first section orthogonal to a flowing direction in which the liquid flows inside the flow path tube and in a second section parallel to the flowing direction, and the convex portion may be protruded more than the peripheral portion both in the first section and in the second section.

The plasma generation apparatus may further include, for example, an insulator which is located to surround the first electrode with a gap therebetween, the insulator having an opening through which the gap and the inside of the flow path tube communicate with each other, wherein the gas introduction path may include the gap and the opening.

With this configuration, the gap produced between the first electrode and the insulator which covers the first electrode can be utilized for the gas introduction path, so that the introduced gas can more easily cover the first electrode. Accordingly, a voltage can be more easily applied in a state in which the gas covers the first electrode. Consequently, power can be efficiently used for plasma generation, and accordingly plasma can be efficiently generated.

The plasma generation apparatus may further include, for example, the first electrode may be a tubular electrode having a hollow which extends in a longitudinal direction, and the gas introduction path may include the hollow.

With this configuration, the hollow which extends the first electrode can be utilized for the gas introduction path, so that the introduced gas can more easily cover the first electrode. Accordingly, a voltage can be more easily applied in a state in which the gas covers the first electrode. Consequently, power can be efficiently used for plasma generation, and accordingly plasma can be efficiently generated.

A plasma generation apparatus according to a second aspect of the present disclosure includes a flow path tube through which a liquid flows, an inside of the flow path tube communicating with an external space of the flow path tube through a gas introduction path, a liquid feed device which generates a swirling flow of the liquid in the inside of the flow path tube, a first electrode at least part of which is located in the inside of the flow path tube, and a second electrode at least part of which is located in the inside of the flow path tube, a power source which applies a predetermined voltage between the first electrode and the second electrode, and a control circuit which makes the liquid feed device generate the swirling flow of the liquid in the inside of the flow path tube, and makes the power source apply a predetermined voltage between the first electrode and the second electrode, wherein the swirling flow of the liquid causes a pressure difference to be generated between at least part of the inside of the flow path tube and the external space of the flow path tube, allowing a gas to be introduced into the liquid from the external space through the gas introduction path, and the power source applies the predetermined voltage between the first electrode and the second electrode in a state in which a bubble containing the gas is generated in the liquid.

With this configuration, the gas can be drawn from the external space into the inside of the flow path tube by utilizing the pressure difference between at least part of the inside of the flow path tube and the external space without using a gas feed device such as a pump. Thus, plasma can be efficiently generated in the gas which is supplied to the inside of the flow path.

Further, for example, the at least part of the first electrode may have a region which is covered with the bubble.

Accordingly, plasma can be efficiently generated in a bubble made of the gas which is introduced to the inside of the flow path tube.

A plasma generation method according to a third aspect of the present disclosure includes (A) flowing a liquid into an inside of a flow path tube while swirling the liquid, to cause a pressure difference to be generated between at least part of an inside of the flow path tube and an external space of the flow path tube, allowing a gas to be introduced into the liquid from the external space through a gas introduction path, and (B) applying a predetermined voltage between a first electrode and a second electrode, in which a state in which a bubble containing the gas is generated in the liquid.

By this method, the gas can be drawn from the external space into the inside of the flow path tube by utilizing the pressure difference between at least part of the inside of the flow path tube and the external space without using a gas feed device such as a pump. Thus, plasma can be efficiently generated in the gas which is supplied to the inside of the flow path tube. Consequently, power which has been used for generation of a gas generated through vaporization of a liquid in related art can be utilized for generation of plasma, so that power saving can be realized.

Embodiments will be specifically described below with reference to the accompanying drawings.

Here, each of the embodiments described below represents a comprehensive or specific example. Numerical numbers, shapes, materials, constituent elements, arranging positions and connecting configurations of constituent elements, steps, and an order of steps which are described in the following embodiments are examples and do not limit the present disclosure. Further, among constituent elements in the following embodiments, constituent elements which are not described in independent claims which represent the primary concept are explained as arbitrary constituent elements.

First Embodiment

[1. Configuration]

The description of a plasma generation apparatus according to a first embodiment is first provided with reference to FIG. 1. FIG. 1 illustrates the configuration of a plasma generation apparatus 10 according to the present embodiment. Here, FIG. 1 shows a section of the configuration of the plasma generation apparatus 10 except for a power source 80 and a control circuit 90.

The plasma generation apparatus 10 according to the present embodiment is an in-liquid plasma generation apparatus which generates plasma 13 in a gas 12 which is supplied into a liquid 11. The gas 12 supplied into the liquid 11 exists as bubbles in the liquid 11. Gas-liquid interfaces of bubbles made of the gas 12 may be closed in the liquid 11 or may communicate with an external space. Further, bubbles made of the gas 12 include an air current in the liquid 11. The air current is generated by continuously supplying the gas 12 to the liquid 11 by a predetermined volume of flow. Hereinafter, the gas 12 supplied into the liquid 11 is sometimes referred to as bubbles collectively.

The liquid 11 flows in the inside of a flow path tube 20 in a swirling manner. Here, in FIG. 1, the liquid 11 flows in the upward direction of the plane of the drawing and a white arrow represents swirling of the liquid 11.

The liquid 11 is water such as purified water and tap water or a water solution, for example. The plasma generation apparatus 10 generates the plasma 13 in the liquid 11 so as to generate active species such as OH radicals in the liquid 11. Accordingly, the liquid 11 can be sterilized. Alternatively, another liquid or gas can be sterilized by using the liquid 11 containing active species. Here, the plasma-treated liquid 11, which contains active species, can be used not only for sterilization but also for other various purposes.

The plasma generation apparatus 10 of the present embodiment does not include a gas supply device such as a pump for supplying the gas 12. The gas 12 is introduced to the flow path tube 20 from an external space 30 due to the swirling flow of the liquid 11 in the inside of the flow path tube 20. In other words, flow of the liquid 11 is associated with introduction of the gas 12. When the liquid 11 does not flow in a swirling manner, the gas 12 is not introduced. That is, the gas 12 cannot be introduced independently of the flow of the liquid 11.

The external space 30 is a space of the outside of the flow path tube 20. The external space 30 has a gas. Specifically, the external space 30 is a space such as a room in which the plasma generation apparatus 10 is disposed, for example. In this case, the external space 30 is filled with air (atmosphere) as the gas 12. The barometric pressure of the external space 30 is the atmospheric pressure, for example.

When the gas 12 is air (atmosphere), the gas 12 is a mixed gas containing nitrogen and oxygen as major ingredients. Alternatively, the gas 12 may be a single gas of oxygen, nitrogen, or argon, or a mixed gas containing at least two of oxygen, nitrogen, and argon. Foreign particles, such as a dust, of the gas 12 may be removed by a filter or the like in advance.

As illustrated in FIG. 1, the plasma generation apparatus 10 includes the flow path tube 20, a first electrode 40, a second electrode 50, an insulator 60, a gas introduction path 70, the power source 80, and the control circuit 90. Each of the constituent elements constituting the plasma generation apparatus 10 according to the present embodiment will be described in detail below.

[1-1. Flow Path Tube]

The flow path tube 20 is a piping, for example, and forms a path through which the liquid 11 flows in a swirling manner. In particular, the flow path tube 20 is composed of a tubular member, examples of which include a pipe, a tube, and a hose. For example, the flow path tube 20 is composed of a pipe of which an internal diameter is 5 mm and a thickness is 3 mm. The flow path tube 20 (e.g., piping) is made of a resin material such as plastic, a metal material such as stainless, or ceramic, for example. The flow path tube 20 may be coated by paint so as to suppress formation of rust, for example.

The flow path tube 20 has an opening on a part of a lateral face thereof so as to introduce a gas to the inside of the flow path tube 20 from the outside. Further, the flow path tube 20 is provided with the gas introduction path 70 which permits communication between the inside of the flow path tube 20 and the external space of the flow path tube 20, on the part of the opening. Details of the gas introduction path 70 will be described later.

The flow path tube 20 has a concave portion 21 on an internal wall surface which comes into contact with the liquid 11. The concave portion 21 is provided so as to swirl the liquid 11. The liquid 11 swirls due to the concave portion 21. In particular, the liquid 11 enters the concave portion 21 and then the flow of the liquid 11 is disturbed. Accordingly, the liquid 11 flows in a swirling manner.

The concave portion 21 is recessed more than the other portions on the internal surface of the flow path tube 20 both in a section orthogonal to the direction in which the liquid flows inside the flow path tube 20 and in a section parallel to this direction. The concave portion 21 is formed by planes to have a rectangular parallelepiped shape, for example. The depth of the concave portion 21 is 2 mm, for example. Here, the shape and the size of the concave portion 21 are not limited to those mentioned above. For example, the concave portion 21 may be formed by curved surfaces. Further, FIG. 1 illustrates an example in which the flow path tube 20 has only a single concave portion 21, but the configuration is not limited to this. The flow path tube 20 may be provided with a plurality of concave portions 21 and thus may allow the liquid 11 to more easily swirl. An example in which the flow path tube 20 is provided with a plurality of concave portions will be described later.

Thus, the liquid 11 flows in a swirling manner due to the concave portion 21 which is provided on the internal wall surface of the flow path tube 20. That is, the liquid 11 forms swirling flow. The flow speed of the liquid 11 is 0.6 liters per minute, for example.

The swirling flow represents that the liquid 11 flows in a manner to turn in a counterclockwise or clockwise direction centering on the direction in which the liquid 11 flows, for example. That is, the liquid 11 flows while swirling about the flowing direction. The swirling of the liquid 11 causes a depressurized region 22 to be generated on the center of swirl. In particular, the depressurized region 22 is generated on the downstream side of the concave portion 21 along the central axis of the flow path tube 20. Thus, the depressurized region 22 is generated in the inside of the flow path tube 20 when the liquid 11 flows in the concave portion 21 of the flow path tube 20.

[1-2. First Electrode]

The first electrode 40 is one of a pair of electrodes provided to the plasma generation apparatus 10. When a predetermined voltage is applied between the first electrode 40 and the second electrode 50, the plasma 13 is generated in bubbles made of the gas 12.

At least a part of the first electrode 40 is disposed in the inside of the flow path tube 20. In the present embodiment, the first electrode 40 is a rod-shaped electrode of which one end portion is disposed in the inside of the flow path tube 20 and the other end portion is disposed in the external space 30, via the opening provided on the lateral face of the flow path tube 20. In particular, one end portion is disposed in the depressurized region 22 which is generated in the inside of the flow path tube 20.

The first electrode 40 is disposed on a position on which at least a part of the first electrode 40 is covered with bubbles made of the gas 12 which is introduced via the gas introduction path 70 which will be described later. The power source 80 which will be described later applies a predetermined voltage between the first electrode 40 and the second electrode 50 in a state in which the first electrode 40 is covered with the gas 12, and thus plasma can be efficiently generated.

As illustrated in FIG. 1, the first electrode 40 includes a metal electrode portion 41 and a metal holding portion 42.

Figure 2:
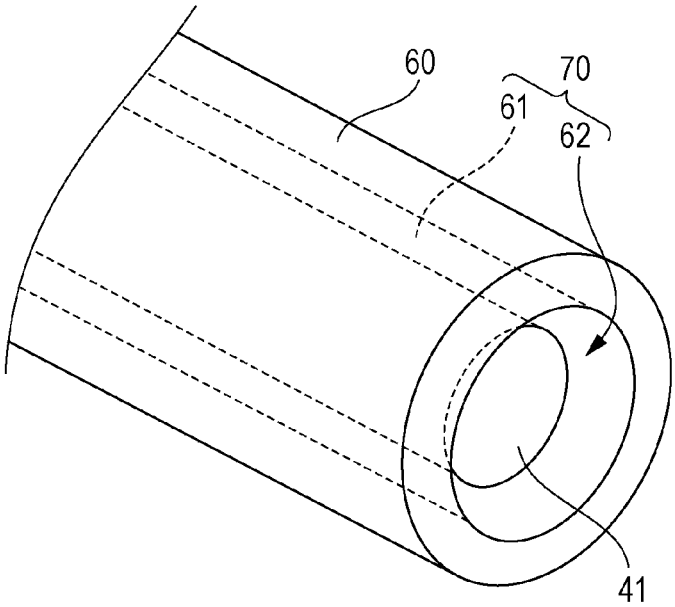
FIG. 2 is a perspective view illustrating the configuration of a part of a first electrode and a part of an insulator according to the first embodiment.

The metal electrode portion 41 is made of a rod-shaped metal material, for example. Specifically, the metal electrode portion 41 has a columnar body, as illustrated in FIG. 2. FIG. 2 is a perspective view illustrating the configuration of a part of the first electrode 40 and a part of the insulator 60 according to the present embodiment. The diameter of the metal electrode portion 41 is, for example, small enough to realize reduction in size of the apparatus. For example, the diameter of the metal electrode portion 41 is equal to or smaller than 2 mm. In one instance, the diameter of the metal electrode portion 41 is 0.95 mm.

The metal electrode portion 41 is surrounded by the insulator 60. In this case, a gap 61 is formed between the metal electrode portion 41 and the insulator 60.

The metal electrode portion 41 is disposed such that one end portion (i.e., front edge) thereof comes into contact with the liquid 11 and the other end portion (i.e., base) thereof is pressed into the metal holding portion 42. Accordingly, the metal electrode portion 41 is physically and electrically connected with the metal holding portion 42. Here, the metal electrode portion 41 is provided so that the metal electrode portion 41 does not protrude outward from an opening portion 62 of the insulator 60.

The metal electrode portion 41 is used as a reaction electrode, around which the plasma 13 is generated.

For the metal electrode portion 41, a conductive metal material can be used. For example, a plasma resistant metal material can be used. In particular, the metal electrode portion 41 is made of tungsten. Here, for the metal electrode portion 41, other plasma resistant metal materials may be used. Alternatively, copper, aluminum, iron, or an alloy of copper, aluminum, and iron may be used, though durability may be degraded.

Further, yttrium oxide which has electrical resistivity of 1 to 30Ωcm due to addition of a conductive substance may be sprayed with respect to a part of a surface of the metal electrode portion 41. The spraying of yttrium oxide can elongate a life of the electrode advantageously.

The metal holding portion 42 is a rod-shaped member, for example. Specifically, the metal holding portion 42 has a columnar body. The diameter of the metal holding portion 42 is larger than that of the metal electrode portion 41, for example. In one instance, the diameter of the metal holding portion 42 is 3 mm.

The metal holding portion 42 is made of iron, for example. The metal holding portion 42 may be made of copper, zinc, aluminum, tin, or brass. The metal holding portion 42 is electrically connected with the power source 80.

Here, a male screw may be provided on the outer circumference of the metal holding portion 42. In this case, the male screw of the metal holding portion 42 may be threaded to a female screw which is provided to a holding block (not illustrated), for example. Furthermore, the holding block may be fixed to the insulator 60, for example. With this configuration, a positional relation between the metal electrode portion 41 and the insulator 60 can be changed by adjusting the screws.

[1-3. Second Electrode]

The second electrode 50 is the other electrode of a pair of electrodes provided to the plasma generation apparatus 10. The second electrode 50 is a rod-shaped electrode, for example. Specifically, the second electrode 50 has a columnar body. The diameter of the second electrode 50 is, for example, small enough to realize reduction in size of the apparatus. For example, the diameter of the second electrode 50 is equal to or smaller than 2 mm. In one instance, the diameter of the second electrode 50 is 2 mm.

The second electrode 50 is disposed such that at least a part thereof comes into contact with the liquid 11. In particular, at least a part of the second electrode 50 is disposed in the inside of the flow path tube 20. Specifically, the second electrode 50 is disposed on the outer side with respect to the insulator 60, in the inside of the flow path tube 20. In the example illustrated in FIG. 1, the second electrode 50 is disposed alongside of the first electrode 40 with the insulator 60 interposed therebetween. However, the configuration is not limited to this. For example, the second electrode 50 may be disposed such that a front edge of the second electrode 50 and a front edge of the first electrode 40 are opposed to each other.

For the second electrode 50, a conductive metal material can be used. The second electrode 50 is made of tungsten, copper, aluminum, or iron, for example.

Here, the second electrode 50 may have a prismatic body. Further, the second electrode 50 does not have to have a columnar body, but the second electrode 50 may have a tubular body or may be a flat plate. Furthermore, the second electrode 50 may be a coiled electrode wound on the outer circumference of the insulator 60. Furthermore, the second electrode 50 may be fixed or detachably fixed on a wall surface of the flow path tube 20.

[1-4. Insulator]

The insulator 60 is disposed to surround the first electrode 40 with the gap 61 interposed therebetween. Specifically, the insulator 60 is disposed to surround the metal electrode portion 41 of the first electrode 40 with the gap 61 provided between the insulator 60 and the metal electrode portion 41, as illustrated in FIG. 1. Further, the insulator 60 has an opening portion 62 through which the inside of the flow path tube 20 and the gap 61 communicate with each other.

The insulator 60 has a hollow cylindrical body, for example, as illustrated in FIG. 2. For example, the metal electrode portion 41 is disposed in the hollow of the insulator 60 so that an axial direction of the metal electrode portion 41 and a tube axis direction of the insulator 60 are parallel to each other. Specifically, the insulator 60 and the metal electrode portion 41 are disposed so that the axis of the metal electrode portion 41 is accorded with the tube axis of the insulator 60. With this arrangement, the gap 61 is provided along the whole circumference of the metal electrode portion 41 and thus the insulator 60 is not brought into contact with the metal electrode portion 41.

The internal diameter of the insulator 60 is equal to or smaller than 3 mm. Note that the diameter of the opening portion 62 as illustrated in FIG. 2 is equal to the internal diameter of the insulator 60. In one instance, the internal diameter of the insulator 60 is 1.0 mm. The thickness of the insulator 60 is not especially limited, but the thickness is equal to or larger than 0.2 mm, for example.

The insulator 60 is made of alumina ceramic, for example. Alternatively, the insulator 60 may be made of magnesia, quartz, or yttrium oxide.

The gap 61 is so-called a minute gap, or micro gap. The gap length of the gap 61 is determined based on an electron temperature and a reduced field of plasma and medium density of a gas, for example. The gap length is equal to or smaller than 0.5 mm, for example.

The opening portion 62 is positioned in the axial direction of the first electrode 40. That is, the opening portion 62 opposes to the front edge of the first electrode 40 in the axial direction of the first electrode 40.

In this case, the front edge of the first electrode 40 is disposed on a position which is retreated inward from the opening portion 62. In other words, when the front end face of the insulator 60, on which the opening portion 62 is provided, is referred to as an opening face, the front edge of the metal electrode portion 41 is retreated from this opening face. The retreating distance is smaller than 7 mm, for example, and desirably from 3 mm to 5 mm inclusive.

Here, the insulator 60 does not limitedly have the cylindrical body, but the insulator 60 may have a polygonal cylindrical body. Further, the insulator 60 may be fixed or detachably fixed on the flow path tube 20.

[1-5. Gas Introduction Path]

The gas introduction path 70 is a path through which the inside of the flow path tube 20 and the external space 30 communicate with each other. The gas introduction path 70 allows the gas 12 to be introduced to the flow path tube 20 so that bubbles made of the gas 12 cover at least a part of the first electrode 40. The gas introduction path 70 is provided in a manner to penetrate the lateral face of the flow path tube 20. In the present embodiment, the gas introduction path 70 is composed of the gap 61 and the opening portion 62.

A first end portion of the gas introduction path 70 corresponds to the opening portion 62, which is positioned in the depressurized region 22 in the inside of the flow path tube 20. In particular, the opening portion 62 is disposed near the central axis of the flow path tube 20. A second end portion of the gas introduction path 70 corresponds to a region between the metal electrode portion 41 and an end portion, which is opposite to the end portion on which the opening portion 62 is provided, of the insulator 60 (that is, an end portion of the gap 61). Thus, the second end portion of the gas introduction path 70 is positioned in the external space 30. The gas introduction path 70 takes in a gas from the second end portion so as to supply the gas from the opening portion 62 into the liquid 11.

In the present embodiment, the gas introduction path 70 introduces the gas 12 from the external space 30 to the depressurized region 22 by utilizing a pressure difference between the depressurized region 22, which is generated in the inside of the flow path tube 20 due to swirling of the liquid 11, and the external space 30. That is, the gas 12 is supplied into the flow path tube 20 not by actively feeding the gas 12 from the external space 30 but by drawing the gas 12 from the depressurized region 22.

[1-6. Power Source]

The power source 80 applies a predetermined voltage between the first electrode 40 and the second electrode 50. Specifically, the power source 80 applies a pulse voltage or an alternating-current voltage between the first electrode 40 and the second electrode 50.

For example, the predetermined voltage is a negative high-voltage pulse of which a voltage is 2 kV/cm to 50 kV/cm and a frequency is 1 Hz to 100 kHz. A voltage waveform may be any of a pulsed wave form, a sine half wave form, and a sine wave form, for example. Further, a value of a current flowing in a pair of electrodes is from 1 mA to 3 A, for example. In particular, the power source 80 applies a pulse voltage of which a peak voltage is 4 kV, a pulse width is 1 μs, and a frequency is 30 kHz. An input power from the power source 80 is 200 W, for example.

When the power source 80 inputs power, a voltage is applied between the first electrode 40 and the second electrode 50. Accordingly, discharging occurs in the gap 61 and thereby the plasma 13 is generated.

[1-7. Control Circuit]

The control circuit 90 is a micro computer or the like in which a program is stored, for example. The control circuit 90 controls an operation of the plasma generation apparatus 10. Specifically, the control circuit 90 causes the power source 80 to apply a voltage between the first electrode 40 and the second electrode 50. The control circuit 90 controls on and off of the power source 80, for example. Accordingly, the control circuit 90 causes discharge to be generated in bubbles made of the gas 12, thereby generating the plasma 13. At this time, the bubbles are made of the gas 12 which is introduced into the liquid 11 from the external space 30 via the gas introduction path 70 due to the pressure difference between the depressurized region 22 and the external space 30. In this case, the depressurized region 22 is generated when the liquid 11 flows in the concave portion 21 of the flow path tube 20. More specifically, the depressurized generated 22 is formed when the liquid 11 swirls in the inside of the flow path tube 20 due to the concave portion 21.

Further, the control circuit 90 may control the flow of the liquid 11 in the inside of the flow path tube 20. In the present embodiment, a liquid feed device (not illustrated) such as a pump for flowing the liquid 11 to the flow path tube 20 is provided. The control circuit 90 is capable of flowing the liquid 11 into the inside of the flow path tube 20 by controlling the liquid feed device.

Here, any liquid feed device may be used as long as the liquid feed device has a function of flowing the liquid 11. For example, the liquid feed device flows the liquid 11 at a predetermined flow speed. In this case, the liquid feed device may not have a function of swirling the liquid 11 but merely has to have a function of discharging the liquid 11. The liquid feed device may have a function of swirling the liquid 11. That is, swirling of the liquid 11 may be generated not due to the concave portion 21. In this case, the internal wall surface of the flow path tube 20 may be a smooth surface without a concave portion or a convex portion. Any method of swirling the liquid 11 may be adopted. It is sufficient if a gas is introduced into the liquid 11 by a pressure difference between the depressurized region 22 which is generated due to swirling and the external space 30.

[2. Modification of Flow Path Tube]

Figure 3A:
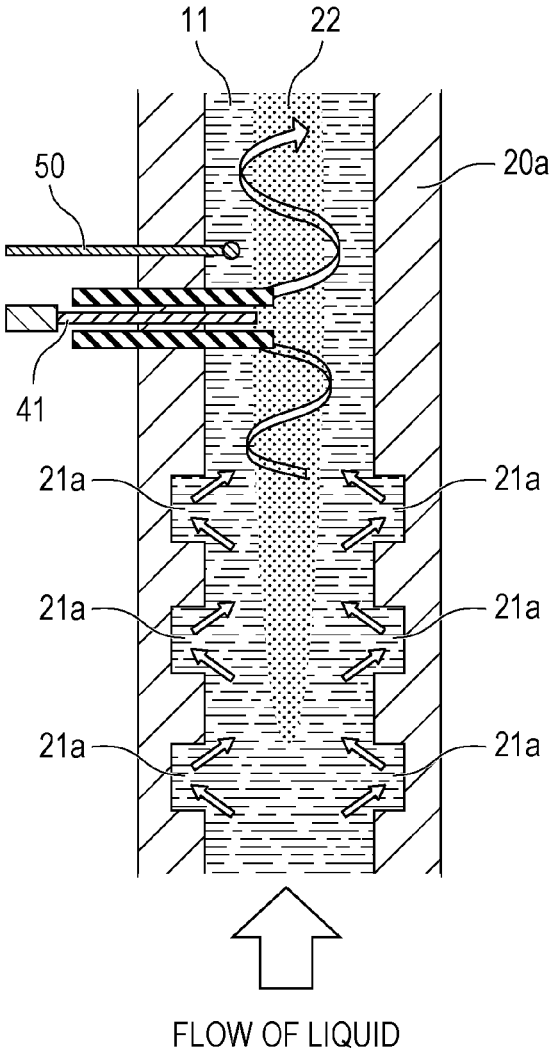
FIG. 3A illustrates a first modified example of a shape of a flow path tube according to the first embodiment.
Figure 3B:
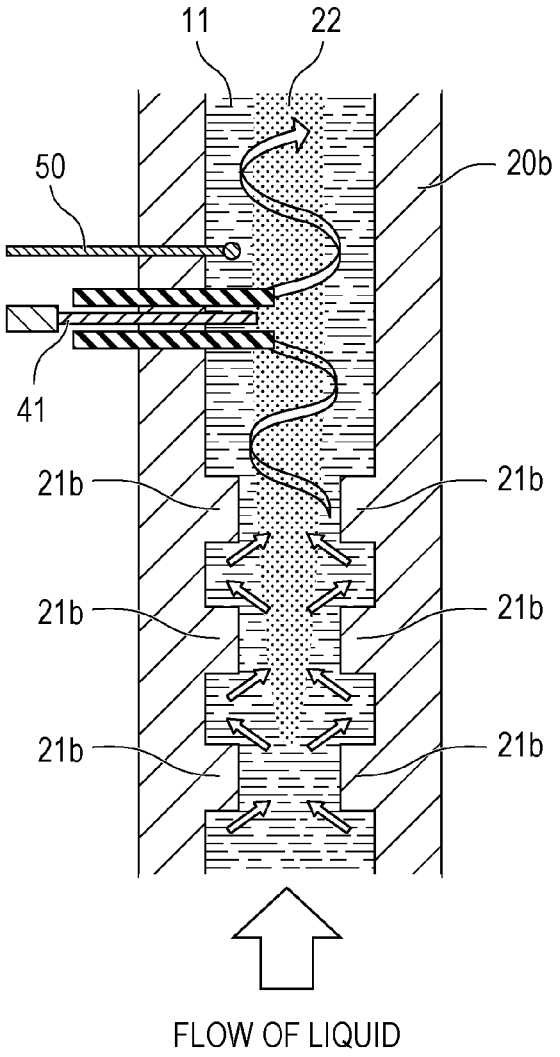
FIG. 3B illustrates a second modified example of the shape of the flow path tube according to the first embodiment.
Figure 3C:
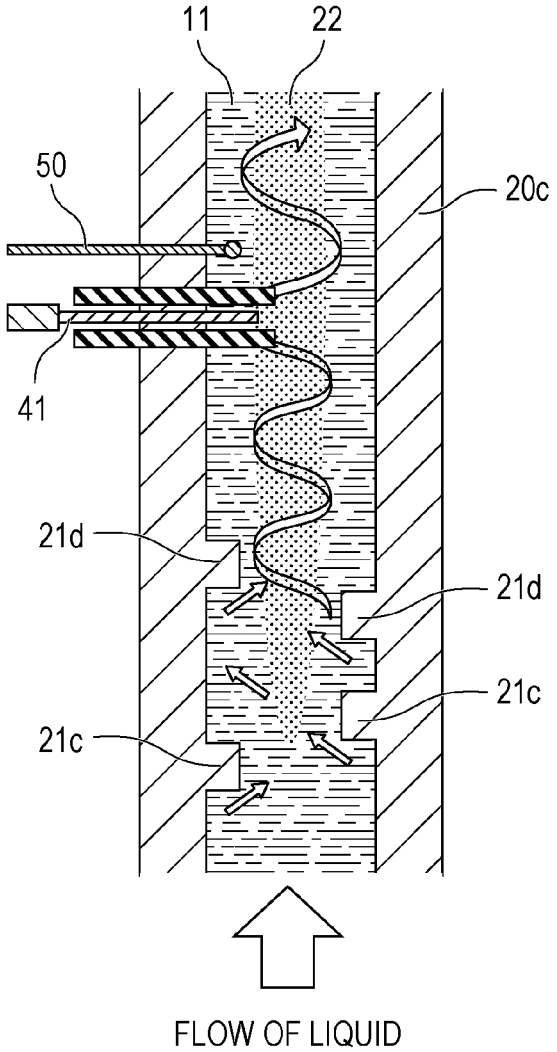
FIG. 3C illustrates a third modified example of the shape of the flow path tube according to the first embodiment.

Modified examples of the flow path tube 20 according to the present embodiment are now described with reference to FIGS. 3A to 3C. FIGS. 3A to 3C respectively illustrate modified examples of the shape of the flow path tube according to the present embodiment.

A flow path tube 20*a* illustrated in FIG. 3A has three concave portions 21*a*. Each of the three concave portions 21*a* is annularly formed along an internal surface of the flow path tube 20*a*. Specifically, each of the three concave portions 21*a* is an annular concave portion centering on the direction in which the liquid 11 flows. As illustrated in FIG. 3A, each of the three concave portions 21*a* has a rectangular section along the direction in which the liquid 11 flows. Here, the shape of the section is not limitedly rectangular but the section may be formed by a smooth curved line.

Provision of a plurality of concave portions 21*a* facilitates swirling of the liquid 11. Instead of a plurality of annular concave portions 21*a*, a single spiral concave portion 21*a* may be provided along the internal surface of the flow path tube 20*a*. The shape, the number, and the disposition of concave portions 21*a* for forming swirling flow are not limited to those described above.

A flow path tube 20*b* illustrated in FIG. 3B has three convex portions 21*b*. Each of the three convex portions 21*b* is annularly formed along an internal surface of the flow path tube 20*b*. Specifically, each of the three convex portions 21*b* is an annular convex portion centering on the direction in which the liquid 11 flows. As illustrated in FIG. 3B, each of the three convex portions 21*b* has a rectangular section along the direction in which the liquid 11 flows. Here, the shape of the section is not limitedly rectangular but the section may be formed by a smooth curved line.

Provision of a plurality of convex portions 21*b* facilitates swirling of the liquid 11. Instead of a plurality of annular convex portions 21*b*, a spiral convex portion 21*b* may be provided along the internal surface of the flow path tube 20*b*. Further, a single convex portion 21*b* may be provided in a spiral fashion. The shape, the number, and the disposition of convex portions 21*b* for forming swirling flow are not limited to those described above. The convex portion 21*b* is a portion which is protruded more than the other portions on the internal surface of the flow path tube 20*b* both in a section orthogonal to the direction in which the liquid flows inside the flow path tube 20*b* and in a section parallel to this direction.

For example, the flow path tube 20*c* illustrated in FIG. 3C has a convex portion 21*c* and a convex portion 21*d*. Each of the convex portion 21*c* and the convex portion 21*d* is annularly formed along an internal surface of the flow path tube 20*c*. Specifically, each of the convex portion 21*c* and the convex portion 21*d* is an annular convex portion centering on the direction which intersects with the direction in which the liquid 11 flows. More specifically, an axis of the convex portion 21*c* provided on an upstream side of the liquid 11 and an axis of the convex portion 21*d* provided on a downstream side of the liquid 11 are slanted in mutually different directions with respect to the direction in which the liquid 11 flows. For example, as illustrated in FIG. 3C, the axis of the convex portion 21*c* is slanted toward the metal electrode portion 41 of the first electrode 40 and the axis of the convex portion 21*d* is slanted to a direction opposite to the direction for the metal electrode portion 41, with respect to the direction in which the liquid 11 flows.

Thus, mutually-different slants of the axes of the convex portion 21*c* and the convex portion 21*d* facilitates swirling of the liquid 11. For example, a turning force of swirling can be enhanced, so that the depressurized region 22 is more easily generated and therefore, the gas 12 is more easily introduced. Accordingly, the plasma 13 can be efficiently generated.

Here, the convex portion 21*b* or the convex portion 21*c* may be formed separately from the flow path tube 20*b* or the flow path tube 20*c*. For example, a cutout is formed on the flow path tube 20*b* or the flow path tube 20*c* and then a plate-like member is inserted from the cutout, being able to form the convex portion 21*b* or the convex portion 21*c*.

Further, examples in which each of the flow path tubes has merely concave portions or merely convex portions are described in the examples illustrated in FIG. 1 and FIGS. 3A to 3C, but the configuration is not limited to this. In the present embodiment, the flow path tube may have both of a concave portion and a convex portion.

[3. Operation]

Figure 4:
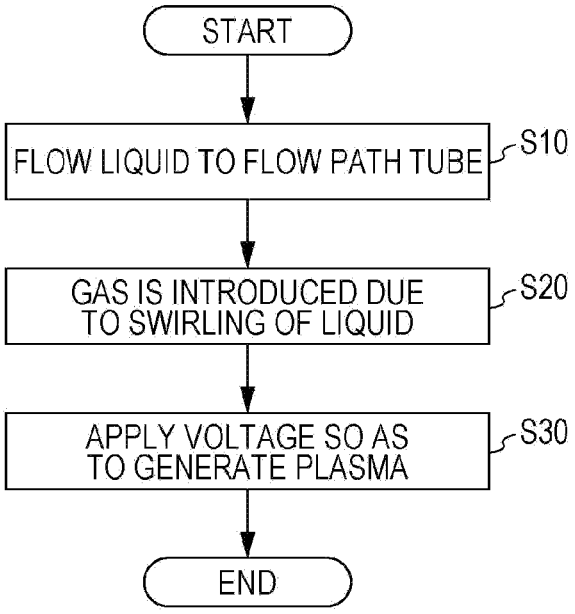
FIG. 4 is a flowchart illustrating an operation of the plasma generation apparatus according to the first embodiment.

An operation of the plasma generation apparatus 10 according to the present embodiment is described with reference to FIG. 4. FIG. 4 is a flowchart illustrating the operation of the plasma generation apparatus 10 according to the present embodiment.

As illustrated in FIG. 4, the liquid 11 is first flown to the flow path tube 20 (S10). For example, a liquid feed device such as a pump feeds the liquid 11 to the flow path tube 20 so as to flow the liquid 11 in the flow path tube 20. When the liquid 11 flows in the flow path tube 20, the flow of the liquid 11 is disturbed by the concave portion 21, making the liquid 11 swirl. Thus, the liquid 11 flows in the inside of the flow path tube 20 in a swirling manner.

The gas 12 is introduced to the inside of the flow path tube 20 due to the swirling of the liquid 11 (S20). Specifically, the liquid 11 swirls to generate the depressurized region 22 at the center of the swirling. In other words, the liquid 11 flows in the concave portion 21 of the flow path tube 20 to generate the depressurized region 22. One end portion of the gas introduction path 70, e.g., the opening portion 62, is disposed in the depressurized region 22, so that the gas 12 is introduced from the external space 30 via the gas introduction path 70.

Then, in a state in which bubbles made of the gas 12 are generated, the power source 80 applies a voltage between the first electrode 40 and the second electrode 50 to generate the plasma 13 in the gas 12 (S30).

Here, step S10 and step S30 may be performed in parallel and step S30 may be performed ahead. However, when a voltage is applied after the gas 12 is introduced by flowing the liquid 11 while allowing the liquid 11 to swirl as illustrated in FIG. 4, plasma can be more efficiently generated.

[4. Advantageous Effects]

As described above, the plasma generation apparatus 10 according to the present embodiment includes the flow path tube 20 through which the liquid 11 flows, the flow path tube 20 including at least one of the concave portion 21 and the convex portion 21*b*, which is located on the internal wall surface of the flow path tube 20, the inside of the flow path tube 20 communicating with the external space of the flow path tube 20 through the gas introduction path 70, the liquid feed device which flows the liquid 11 into the flow path tube 20, the first electrode 40 at least part of which is located in the inside of the flow path tube 20, the second electrode 50 at least part of which is located in the inside of the flow path tube 20, the power source 80 which applies a predetermined voltage between the first electrode 40 and the second electrode 50, and the control circuit 90 which makes the liquid feed device flow the liquid into the flow path tube 20, and makes the power source 80 apply a predetermined voltage between the first electrode 40 and the second electrode 50. The at least one of the concave portion 21 and the convex portion 21*b* causes, when the liquid flows therethrough, a pressure difference to be generated between at least part of the inside of the flow path tube 20 and the external space of the flow path tube 20, allowing the gas 12 to be introduced into the liquid from the external space through the gas introduction path 70. Specifically, the depressurized region 22 is generated when the liquid 11 swirls in the inside of the flow path tube 20 due to the concave portion 21 or the convex portion 21*b*, thereby generating the pressure difference. The power source 80 applies the predetermined voltage between the first electrode 40 and the second electrode 50 in a state in which a bubble containing the gas 12 is generated in the liquid.

Accordingly, the gas 12 can be supplied into the liquid 11 in the inside of the flow path tube 20 without using a gas feed device such as a pump, and then the plasma 13 can be efficiently generated in the supplied gas 12. Consequently, power which has been used for generation of a gas generated through vaporization of a liquid in related art can be utilized for generation of plasma, so that power saving or downsizing can be realized.

Second Embodiment

A plasma generation apparatus according to a second embodiment is described with reference to FIG. 5 and FIG. 6.

Figure 5:
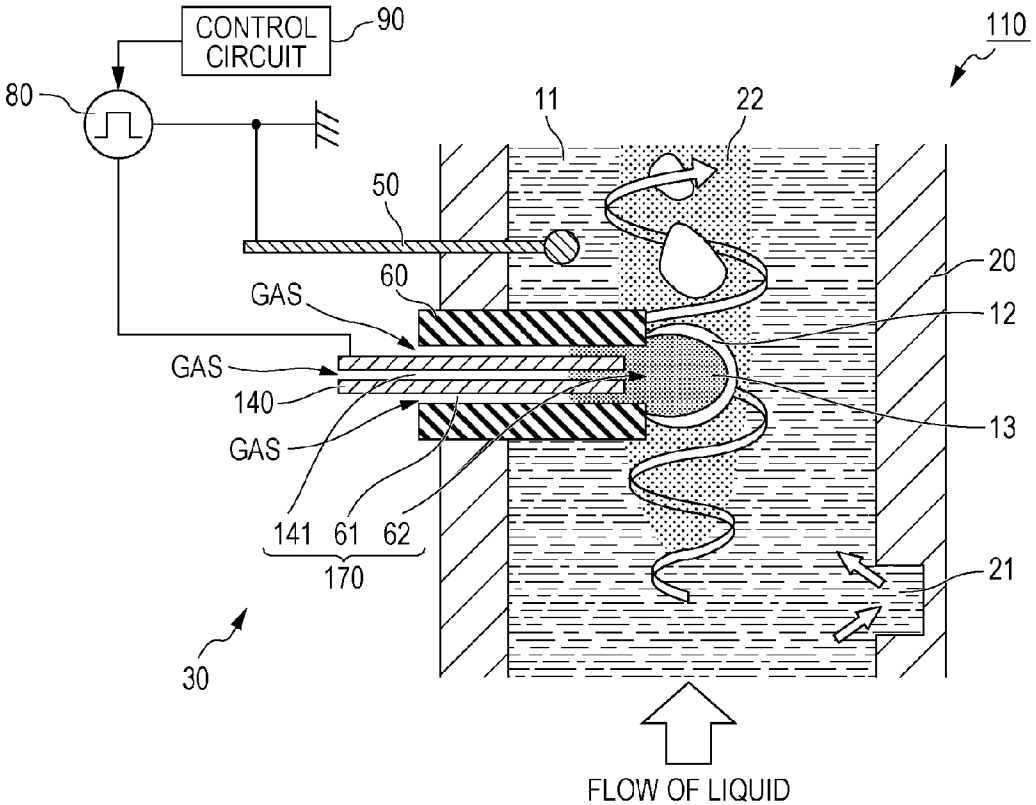
FIG. 5 illustrates the configuration of a plasma generation apparatus according to a second embodiment.

FIG. 5 illustrates the configuration of a plasma generation apparatus 110 according to the present embodiment. FIG. 5 shows a section of the configuration of the plasma generation apparatus 110 except for the power source 80 and the control circuit 90.

The plasma generation apparatus 110 according to the present embodiment is different from the plasma generation apparatus 10 illustrated in FIG. 1 in that the plasma generation apparatus 110 is provided with a first electrode 140 and a gas introduction path 170 instead of the first electrode 40 and the gas introduction path 70. Points different from the first embodiment will be focused to be described below.

The first electrode 140 is one of a pair of electrodes provided to the plasma generation apparatus 110. When a predetermined voltage is applied between the first electrode 140 and the second electrode 50, the plasma 13 is generated in the gas 12. That is, the first electrode 140 is used as a reaction electrode, around which the plasma 13 is generated.

The first electrode 140 is surrounded by the insulator 60. In this case, the gap 61 is formed between the first electrode 140 and the insulator 60.

At least a part of the first electrode 140 is disposed in the inside of the flow path tube 20. In the present embodiment, the first electrode 140 is a tubular electrode having a hollow portion 141 which penetrates in the longitudinal direction. One end portion is disposed in the inside of the flow path tube 20, and the other end portion is disposed in the external space 30. The first electrode 140 permits communication between the external space 30 and the inside of the flow path tube 20 via the hollow portion 141. In particular, one end portion is disposed in the depressurized region 22 which is generated in the inside of the flow path tube 20.

Figure 6:
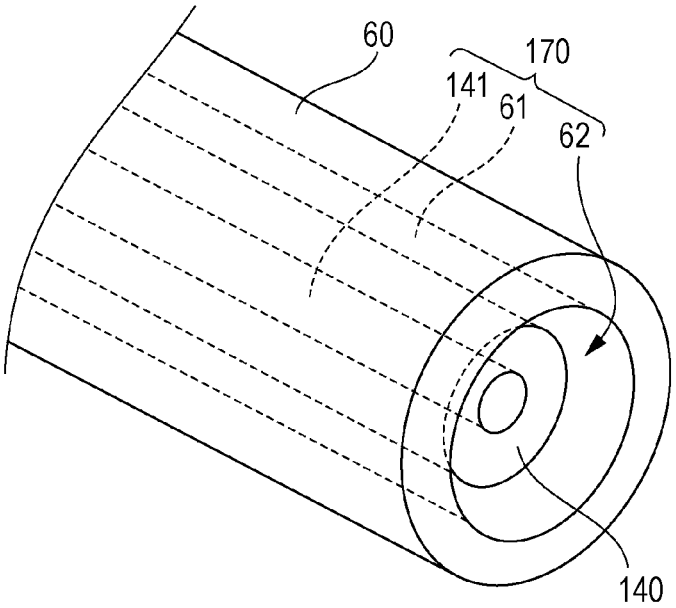
FIG. 6 is a perspective view illustrating the configuration of a part of a first electrode and a part of an insulator according to the second embodiment.

As illustrated in FIG. 6, the first electrode 140 has a hollow cylindrical body. FIG. 6 is a perspective view illustrating the configuration of a part of the first electrode 140 and a part of the insulator 60 according to the present embodiment. The external diameter of the first electrode 140 is, for example, small enough to realize reduction in size of the apparatus. For example, the external diameter of the first electrode 140 is equal to or smaller than 2 mm. In one instance, the external diameter of the first electrode 140 is 2 mm. Here, the first electrode 140 may be made of the same material as that of the metal electrode portion 41 according to the first embodiment.

The hollow portion 141 is a through hole which penetrates the first electrode 140 in the axial direction. The diameter of the hollow portion 141, i.e., the internal diameter of the first electrode 140, is equal to or smaller than 0.9 mm, for example. In one instance, the diameter of the hollow portion 141 is 0.3 mm. Here, in the hollow portion 141, one or more through holes which penetrate a lateral face of the first electrode 140 may be separately provided.

Here, the first electrode 140 may have a polygonal hollow cylindrical body. Further, the sectional shape orthogonal to the tube axis direction of the hollow portion 141 is not limited to a circular shape but may be an oval shape, a rectangular shape, for example.

The gas introduction path 170 is a path through which the inside of the flow path tube 20 and the external space 30 communicate with each other. The gas introduction path 170 allows the gas 12 to be introduced to the flow path tube 20 so that the gas 12 covers at least a part of the first electrode 140. In the present embodiment, the gas introduction path 170 is composed of the gap 61, the hollow portion 141, and the opening portion 62.

In the present embodiment, the opening portion 62 of the insulator 60 permits communication not only between the gap 61 and the inside of the flow path tube 20 but also between the hollow portion 141 and the inside of the flow path tube 20.

A first end portion of the gas introduction path 170 corresponds to the opening portion 62, which is positioned in the depressurized region 22 in the inside of the flow path tube 20. In particular, the opening portion 62 is disposed near the central axis of the flow path tube 20. Further, A second end portion of the gas introduction path 170 corresponds to an end portion of the hollow portion 141, which is positioned in the external space 30. The gas introduction path 170 takes in a gas from the second end portion so as to supply the gas into the liquid 11 from the opening portion 62.

In the present embodiment, the gas introduction path 170 introduces the gas 12 from the external space 30 to the depressurized region 22 by utilizing a pressure difference between the depressurized region 22, which is generated in the inside of the flow path tube 20 due to swirling of the liquid 11, and the external space 30, as is the case with the first embodiment. The hollow portion 141 is also utilized for the gas introduction path 170, so that more volumes of gas can be taken in compared to the first embodiment.

As a modification, the first electrode 140 and the insulator 60 may be in close contact with each other. That is, the gap 61 does not have to be formed. In this case, the gas introduction path 170 is composed of the hollow portion 141.

As described above, in the plasma generation apparatus 110 according to the present embodiment, the first electrode 140 is a tubular electrode having the hollow portion 141 which penetrates in the longitudinal direction, thereby permitting the communication between the external space 30 and the inside of the flow path tube 20. The gas introduction path 170 is composed of the hollow portion 141 and the opening portion 62.

Accordingly, since the hollow portion 141 which penetrates the first electrode 140 can be utilized for the gas introduction path 170, the gas 12 introduced more easily covers the first electrode 140, so that a voltage can be more easily applied in a state in which the gas 12 covers the first electrode 140. Consequently, power can be efficiently used for generation of the plasma 13, and thus the plasma 13 can be efficiently generated.

Other Embodiments

The plasma generation apparatus and a plasma generation method according to a single or a plurality of aspects have been described above based on the embodiments. However, the present disclosure is not limited to these embodiments. Without departing from the intent of the present disclosure, embodiments which are obtained by applying various kinds of modifications thought by those skilled in the art and embodiments which are constituted by combining constituent elements of different embodiments are also included in the scope of the present disclosure.

For example, the liquid 11 is swirled by the concave portion or the convex portion which is provided on the internal wall surface of the flow path tube 20 in the embodiments described above, but the present disclosure is not limited to this. For example, the internal wall surface of the flow path tube 20 may be a smooth surface without concave or convex portion. In this case, a liquid feed device provided to the flow path tube 20 may swirl the liquid 11, for example. That is, any methods for swirling the liquid 11 may be adopted.

Further, the gap 61 between the first electrode 40 and the insulator 60 is utilized for the gas introduction path 70 in the above-described embodiments, for example, but the present disclosure is not limited to this. The gas introduction path 70 may be composed of a tubular member such as a tube which is provided separately from the first electrode 40 and the insulator 60. For example, one opening of a tubular member may be disposed in the vicinity of the first electrode 40 and in the depressurized region 22 so that a gas supplied from the tubular member covers the first electrode 40.

Further, the plasma generation apparatus 10 only has to include at least the first electrode 40, the second electrode 50, and the gas introduction path 70, for example. Specifically, by disposing the first electrode 40, the second electrode 50, and the gas introduction path 70 in an arbitrary flow path tube, plasma can be generated in a liquid which flows in the inside of the flow path tube in a swirling manner.

Further, various kinds of alterations, replacements, additions, and omissions may be performed in each of the above-described embodiments within the scope of the claims and the equivalent scopes.

The present disclosure can be utilized as a plasma generation apparatus which is capable of efficiently generating plasma. The present disclosure can be utilized for a sterilizer, a water purification apparatus, and a material processing apparatus, for example.

While the present disclosure has been described with respect to exemplary embodiments thereof, it will be apparent to those skilled in the art that the disclosure may be modified in numerous ways and may assume many embodiments other than those specifically described above. Accordingly, it is intended by the appended claims to cover all modifications of the disclosure that fall within the true spirit and scope of the disclosure.

What is claimed is:

1. A plasma generation apparatus comprising:

a flow path tube through which a liquid flows, the flow path tube including at least one of a concave portion and a convex portion which is located on an internal wall surface of the flow path tube, an inside of the flow path tube communicating with an external space of the flow path tube through a gas introduction path;

a liquid feed device which flows the liquid into the flow path tube;

a first electrode at least part of which is located in the inside of the flow path tube;

a second electrode at least part of which is located in the inside of the flow path tube;

a power source which applies a predetermined voltage between the first electrode and the second electrode; and a control circuit which makes the liquid feed device flow the liquid into the flow path tube, and makes the power source apply a predetermined voltage between the first electrode and the second electrode, wherein the at least one of the concave portion and the convex portion causes, when the liquid flows therethrough, a pressure difference to be generated between at least part of the inside of the flow path tube and the external space of the flow path tube, to cause a gas to be introduced into the liquid from the external space through the gas introduction path, the power source applies the predetermined voltage between the first electrode and the second electrode in a state in which a bubble containing the gas is generated in the liquid, and the gas is introduced into the liquid without use of a gas feed device.

2. The plasma generation apparatus according to claim 1, wherein the concave portion is recessed more than a peripheral portion on the internal wall surface of the flow path tube both in a first section orthogonal to a flowing direction in which the liquid flows inside the flow path tube and in a second section parallel to the flowing direction, and the convex portion is protruded more than the peripheral portion both in the first section and in the second section.

3. The plasma generation apparatus according to claim 1, further comprising:

an insulator which is located to surround the first electrode with a gap therebetween, the insulator having an opening through which the gap and the inside of the flow path tube communicate with each other, wherein the gas introduction path includes the gap and the opening.

4. The plasma generation apparatus according to claim 1, wherein the first electrode is a tubular electrode having a hollow which extends in a longitudinal direction, and the gas introduction path includes the hollow.

5. The plasma generation apparatus according to claim 1, wherein the at least part of the first electrode has a region which is covered with the bubble.

6. The plasma generation apparatus according to claim 1, wherein the concave portion is recessed from the internal wall surface in a direction orthogonal to a flowing direction in which the liquid flows inside the flow path tube.

7. The plasma generation apparatus according to claim 1, wherein the convex portion protrudes outwardly from the internal wall surface in a direction orthogonal to a flowing direction in which the liquid flows inside the flow path tube.

8. A plasma generation apparatus comprising:

a flow path tube through which a liquid flows, an inside of the flow path tube communicating with an external space of the flow path tube through a gas introduction path;

a liquid feed device which generates a swirling flow of the liquid in the inside of the flow path tube;

a first electrode at least part of which is located in the inside of the flow path tube;

a second electrode at least part of which is located in the inside of the flow path tube;

a power source which applies a predetermined voltage between the first electrode and the second electrode; and a control circuit which makes the liquid feed device generate the swirling flow of the liquid in the inside of the flow path tube, and makes the power source apply a predetermined voltage between the first electrode and the second electrode, wherein the swirling flow of the liquid causes a pressure difference to be generated between at least part of the inside of the flow path tube and the external space of the flow path tube, to cause a gas to be introduced into the liquid from the external space through the gas introduction path, the power source applies the predetermined voltage between the first electrode and the second electrode in a state in which a bubble containing the gas is generated in the liquid, and the gas is introduced into the liquid without use of a gas feed device.

9. The plasma generation apparatus according to claim 8, wherein the at least part of the first electrode has a region which is covered with the bubble.

* * * * *